US006305533B1

(12) United States Patent
Welty et al.

(10) Patent No.: US 6,305,533 B1
(45) **Date of Patent: *Oct. 23, 2001**

(54) CONVERTIBLE SHOE BOX AND DISPLAY PLATFORM

(75) Inventors: Rod Welty, Rogers; Joe Trybulec, Bentonville; Mark Hill, Bentonville; Dana Daniels, Bentonville, all of AR (US)

(73) Assignee: Wal-Mart Stores, Inc., Bentonville, AR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/138,678

(22) Filed: Aug. 24, 1998

(51) Int. Cl.[7] ..... B65D 85/18
(52) U.S. Cl. ..... 206/278; 206/752; 229/108
(58) Field of Search ..... 206/736, 278, 206/751, 752, 45.2, 45.21, 746, 756, 45.22; 229/108, 125.19

(56) References Cited

U.S. PATENT DOCUMENTS

| | | | | |
|---|---|---|---|---|
| 193,366 | * | 7/1877 | Dreyfus | 206/45.2 |
| 1,104,253 | * | 7/1914 | Dunphee | 206/45.2 |
| 1,930,031 | * | 10/1933 | Andrews | 206/45.2 X |
| 2,137,906 | * | 2/1938 | Cummings | 206/45.2 X |
| 2,486,554 | * | 11/1949 | Chemlinski | 206/45.2 X |
| 3,379,304 | * | 4/1968 | Mertz | 206/736 |
| 3,521,810 | * | 7/1970 | Boyer | 229/125.19 |
| 3,924,354 | * | 12/1975 | Gregoire | 206/45.2 X |
| 5,193,675 | * | 3/1993 | Otis | 206/278 |
| 5,375,702 | * | 12/1994 | Fiallo | 206/45.21 |
| 5,706,953 | * | 1/1998 | Polvere | 206/736 |

* cited by examiner

*Primary Examiner*—Allan N. Shoap
*Assistant Examiner*—Tri M. Mai

(57) ABSTRACT

A convertible shoe box and display platform has assembled and disassembled configurations for storing and displaying a pair of shoes. Such box assembly includes a first, container portion, a second, lid portion adapted to cover the container portion, and thereby enclose the pair of shoes within the assembled box, and tabs for positioning the disassembled box as a display platform with the pair of shoes remaining in the container portion. In such a manner, the pair of shoes is effectively displayed for sale.

9 Claims, 12 Drawing Sheets

CONVERTIBLE SHOE BOX AND DISPLAY PLATFORM

BACKGROUND OF THE INVENTION

1. Field of the Invention

The present invention relates generally to paperboard boxes which are adaptable for storage of a single pair of shoes, and more particularly to an improved shoe box which is easily convertible from its storage function into a display platform.

2. Statement of the Prior Art

A shipping container's structural design must be considered separately from its graphic elements. When packaging plays a role in sales, separation of these elements is not easy. The structure can affect the graphics, and graphic requirements may affect the structure. The two functions must be separated because, typically, at least two people are involved, each responsible for one of the two elements. The more that structure and graphics are interdependent, the more these people must work together.

Shoe box designs are no different. The structure must be durable enough to withstand shipping and storage, while the graphics must be attractive enough to quickly identify the manufacturer or merchant and spur on sales. Heretofore, the design of shoe box structures has not contemplated incorporation of any marketing function previously attributed to the design of shoe box graphics.

Every box manufacturing plant employs a structural designer. The designer must be familiar with the capabilities and limitations of every type and grade of board, every piece of equipment in the box plant, every quality control procedure and every test. Hands-on experience is backed with extensive study of design files, packaging regulations, performance characteristics, coatings, packaging machinery capabilities, customer packaging practices, and other pieces of related information. Assisted by the sales force and the customer, the designer becomes familiar with competitors.

Most structural design problems have more than one solution. Ultimately, the designer and the customer make choices. There are times when tried-and-true ideas should be adopted or adapted, and times when fresh ideas can be an advantage. The designer's task is to develop the most effective and economical combination of material and structure to achieve the packaging objective.

The first challenge is the clear and complete statement of the objective. Many elements must be considered, and they are best determined by asking a series of questions. Any question or topic that does not apply can be set aside easily, but every question that might apply must be asked. Two broad questions are basic: 1) what is the product?; and 2) what is the packaging need? As simple as those questions may sound, they are complex.

In the case of shoes, however, the answer to the former question is easy: shoes of all types, including boots, sandals, slippers, and the like, one pair each. Where such shoes are sold in specialty or retail stores, the answer to the latter question is also easy: the box must be strong enough to ship and store the shoes, simple enough to maximize the numbers of pairs of shoes that may be stored within a given unit volume, and straightforward enough to identify one style of shoes from another. Personalized service by salespersons eliminates the need for attractive, flashy outer packaging.

With high-volume discount retailers of shoes, on the other hand, there is a need for shoe boxes which are equally durable yet capable of performing a host of marketing functions. There are few if any salespersons to provide personalized service to the customers of such high-volume discount retailers. Moreover, shoes on sale at such retailers must be available at the point of sale not in the back of some storage room. Accordingly, there is a need for strong, simply designed, quickly convertible shoe boxes and display platforms that are capable of maximizing the number of shoes available on a given amount of shelf space.

SUMMARY OF THE INVENTION

It is a general object of the present invention to provide paperboard boxes which are adaptable for storage of a single pair of shoes.

It is a more particular object of the present invention to provide an improved shoe box which is easily convertible from its storage function into a display platform.

These and other objects according to the present invention are provided by a convertible shoe box and display platform generally comprising a box assembly which has assembled and disassembled configurations for storing and displaying a pair of shoes. Such box assembly includes a first, container portion, a second, lid portion adapted to cover the container portion, and thereby enclose the pair of shoes within the assembled box, and means for positioning the disassembled box as a display platform with the pair of shoes remaining in the container portion. In such a manner, the pair of shoes is effectively displayed for sale.

The positioning means according to the present invention preferably comprises one or more integral parts of the lid portion. For example, the positioning means may suitably comprise a pair of tabs. Each of the tabs is disposed in opposition to the other on a respective side of the lid portion. Such tabs may comprise a substantially semi-circular shape, square shape, rectangular shape, triangular shape, semi-elliptical shape, or any other suitable shape adapted for extension inwardly from the respective side of the lid portion. For example, a scored or cut part of each tab would permit the tab to be pushed into the underside of the lid portion and remain integrally attached to the lid portion by a fold line.

According to one important aspect of the present invention, the container portion and the lid portion each comprise a substantially wedge-shape which is complementary to the other. In such a manner, when the container portion is positioned within the lid portion for the purpose of functioning as a display platform, such wedge shapes provide for an optimal display of the shoes inside. The positioning means, thus, is adapted to elevate the container portion together with the pair of shoes remaining therein at an effective angle (e.g., ten to fifteen degrees) for display.

In accordance with another important aspect of the present invention, a method is disclosed for storing, shipping, and offering a pair of shoes for sale within a combined shoe box and display platform. Such method generally comprises the steps of: first providing a first portion adapted to contain the pair of shoes; second providing a second portion adapted to cover the first portion, and thereby enclose the pair of shoes for storage and shipment in an assembled configuration; and third providing means for positioning the first portion and the second portion in a disassembled configuration by supporting the pair of shoes contained within the first portion at an effective angle for display.

The third providing step preferably comprises the steps of: forming a pair of tabs as an integral part of the second portion on opposing sides thereof, extending the pair of tabs inwardly from such opposing sides, supporting the pair of shoes contained within the first portion upon the inwardly extending pair of tabs. More particularly, the third providing step may suitably comprise the steps of: forming two or more pairs of tabs as an integral part of the second portion on opposing sides thereof, each of the pairs of tabs formed at a relatively different height of the opposing sides; selecting a pair of the tabs, extending the selected pair of tabs inwardly from the opposing sides, and supporting the pair of shoes contained within the first portion upon the inwardly extending pair of tabs.

The extending step may, in accordance with a presently preferred embodiment of the invention, comprise the steps of: pressing a first tab inwardly from its respective side of the second portion to a position substantially perpendicular therefrom; and pressing a second tab inwardly from an opposite side of the second portion to a position substantially perpendicular therefrom. In such a manner, the first tab and the second tab are positioned at the same height.

Alternatively, the extending step comprises the steps of: pressing a first tab inwardly from its respective side of the second portion to a position substantially perpendicular therefrom; and pressing a second tab inwardly from an opposite side of the second portion to a position substantially perpendicular therefrom. In such a manner, the first tab and the second tab are positioned at different heights. This permits the shoes to be displayed canted at an angle within the lid portion.

The combined shoe box and display platform according to the present invention, thus, may serve as an inner container, a shipping container, a display shipper, and a display. Movement from packing line to the customer who will unpack it, is thereby facilitated, while safe storage and transfer from intermediate distributors and warehouses is assured The box ably serves a valuable sales function, where it will be visible at the point of sale, alone or as part of a mass display. Therefore, its novel structural design enhances its appeal.

Further objects, advantages, and novel features according to the present invention will become more apparent from the following detailed description of a preferred embodiment thereof, when considered in conjunction with the accompanying drawings wherein:

DETAILED DESCRIPTION OF THE PREFERRED EMBODIMENT

Figure 1:
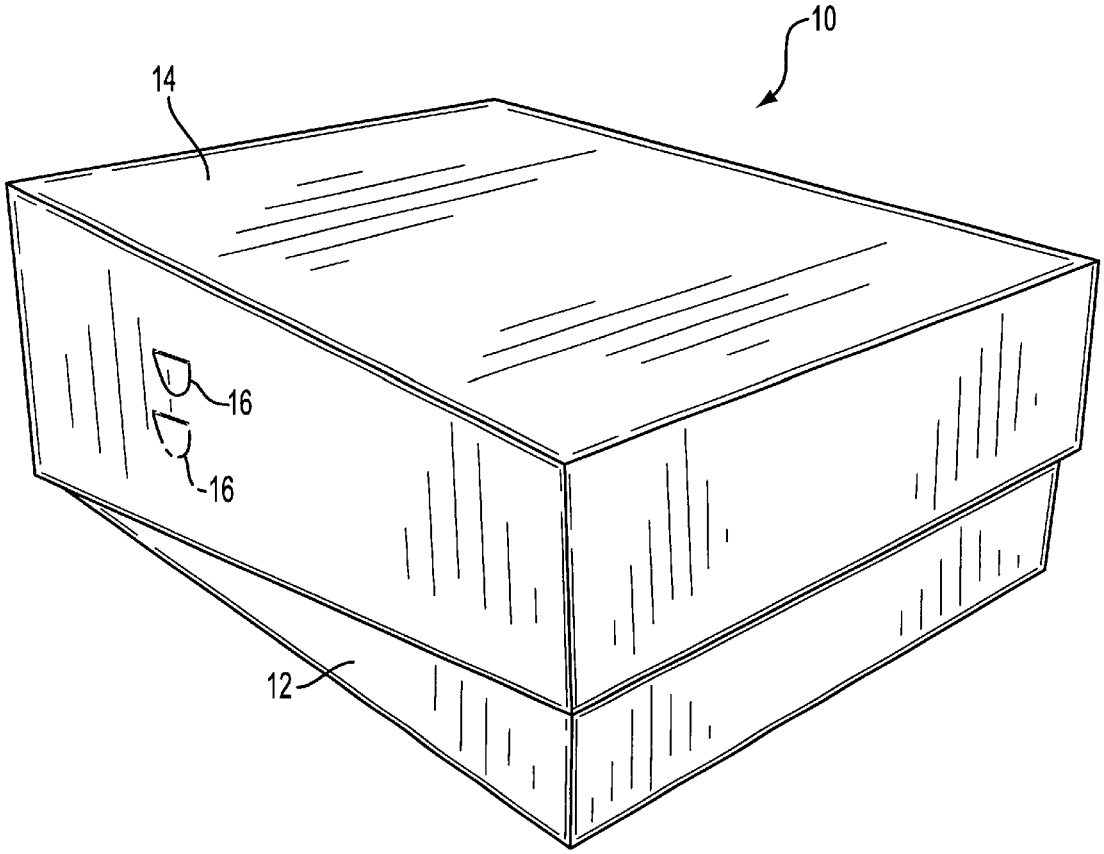
FIG. 1 is a perspective view of the convertible shoe box and display platform according to the present invention, shown in its enclosed shoe box configuration.
Figure 2:
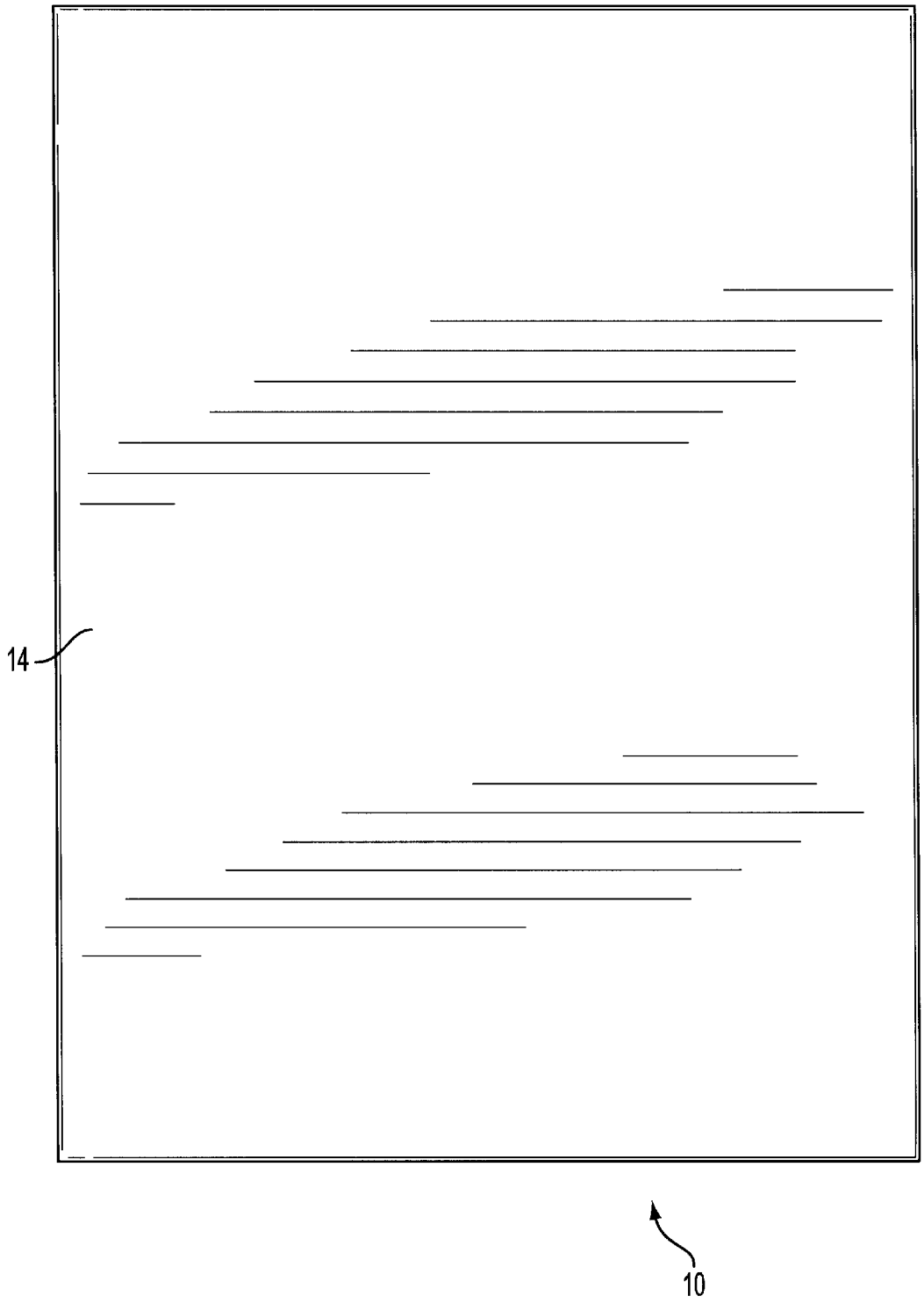
FIG. 2 is a top view of the convertible shoe box and display platform shown in FIG. 1.
Figure 3:
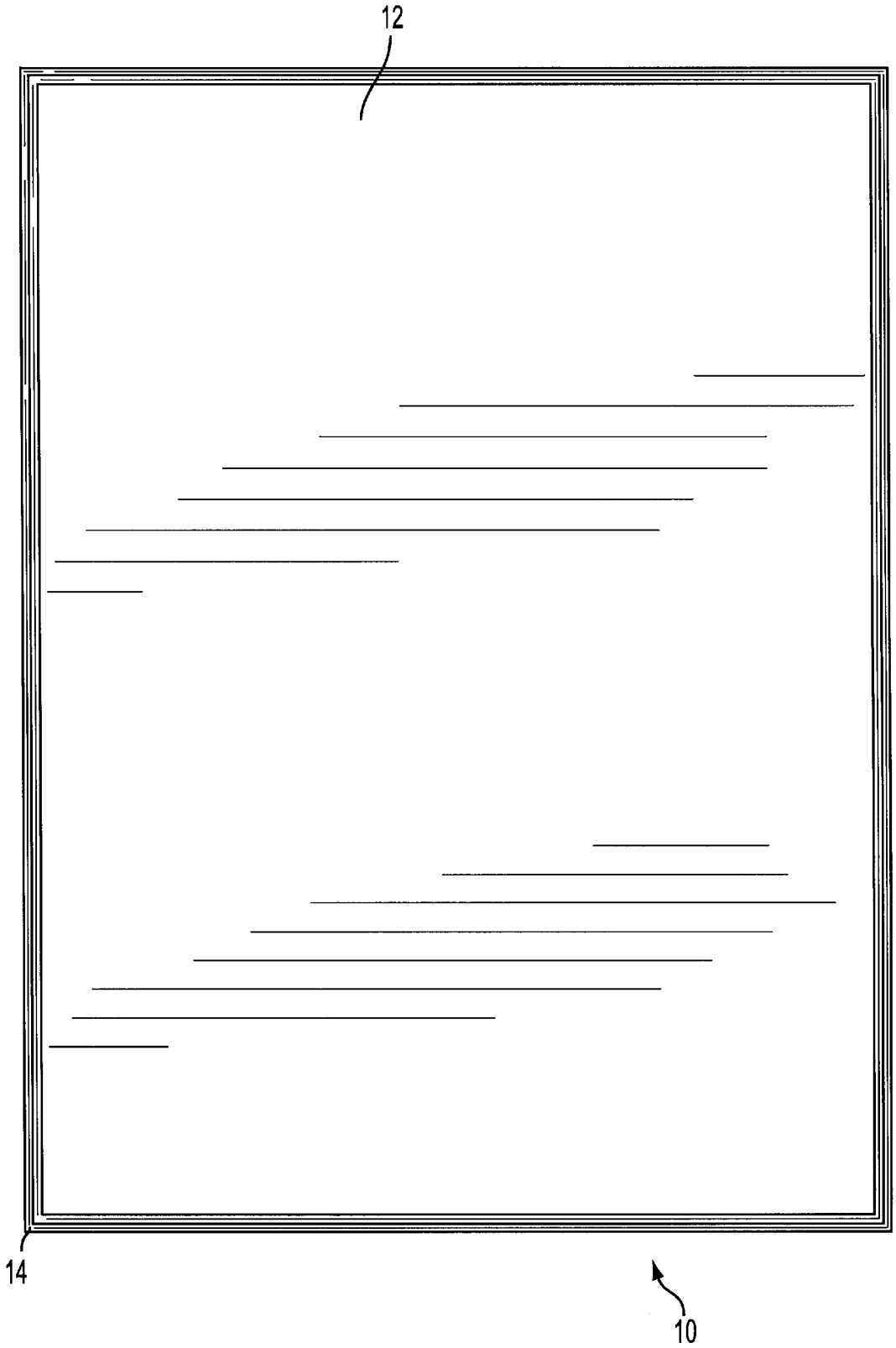
FIG. 3 is a bottom view of the convertible shoe box and display platform shown in FIG. 1.
Figure 4:
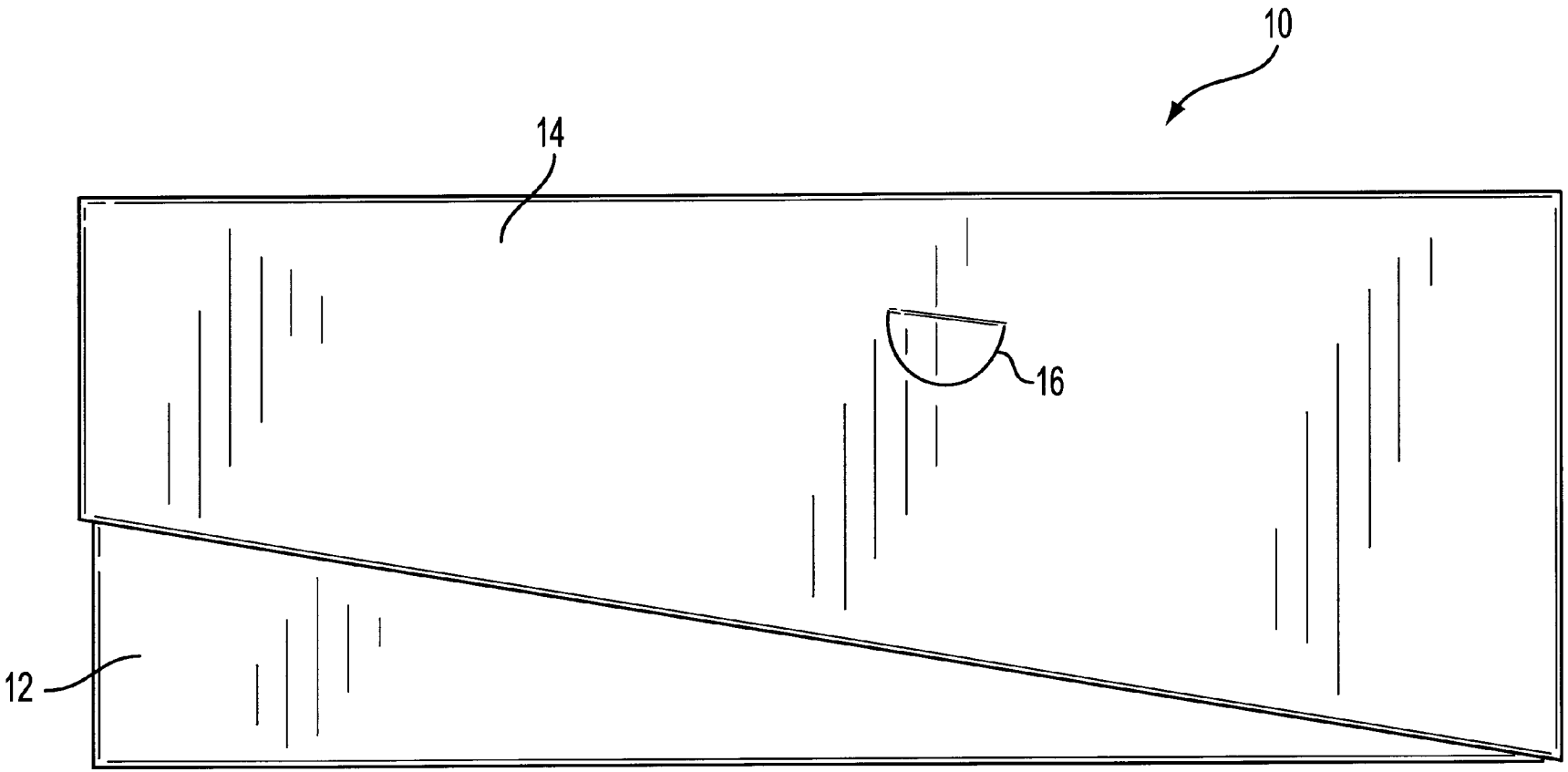
FIG. 4 is a side view of the convertible shoe box and display platform shown in FIG. 1.
Figure 5:
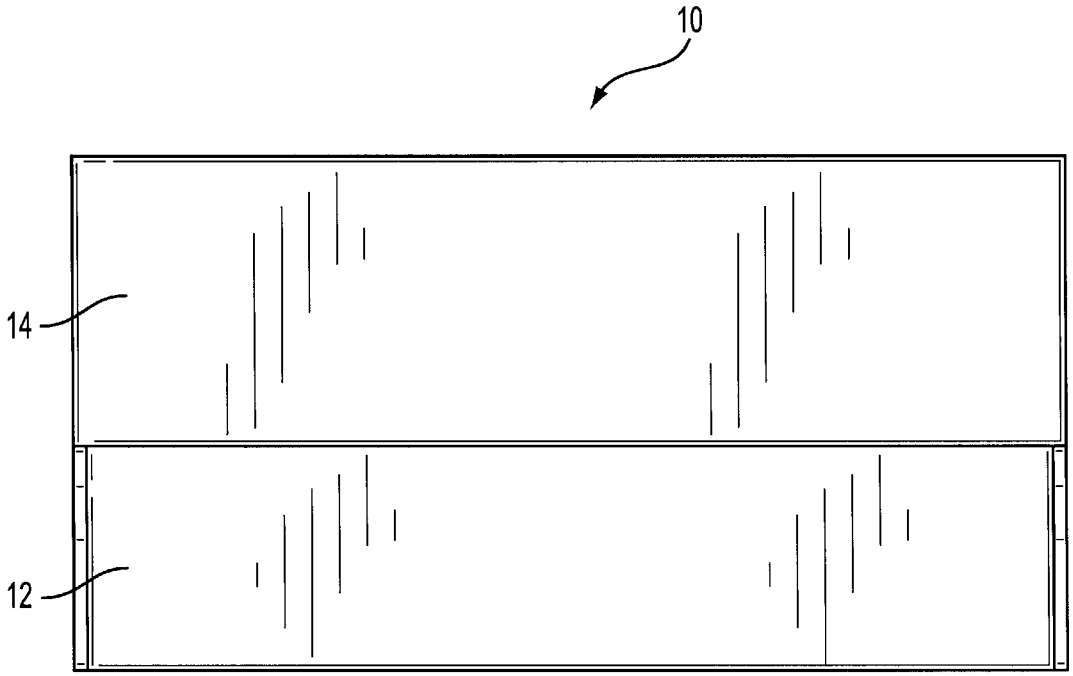
FIG. 5 is a front view of the convertible shoe box and display platform shown in FIG. 1.
Figure 6:
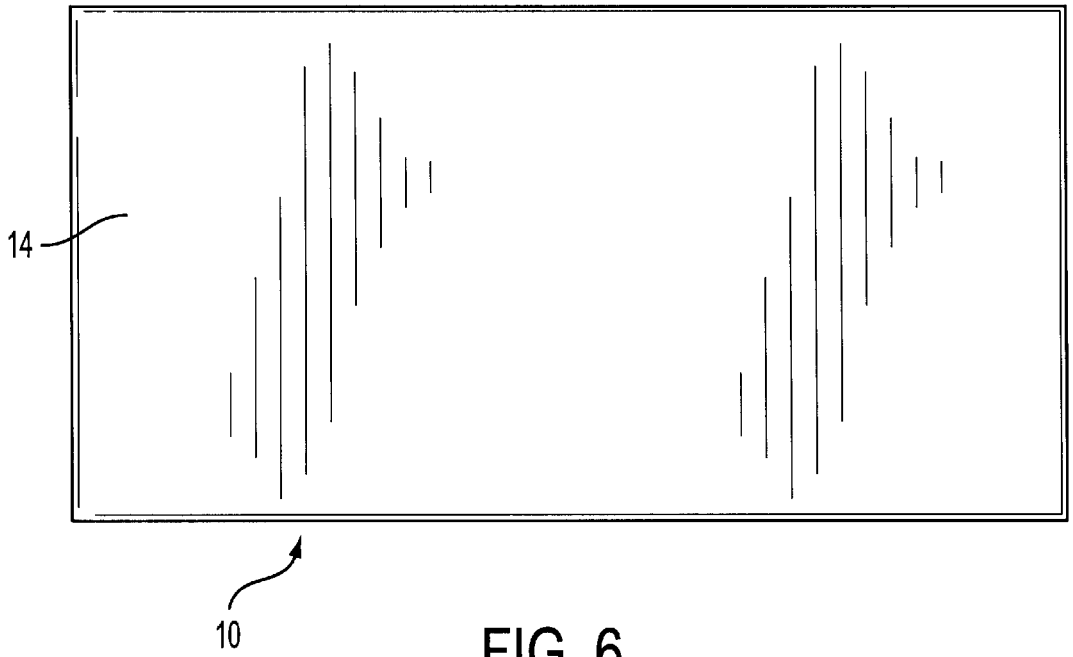
FIG. 6 is a back view of the convertible shoe box and display platform shown in FIG. 1.
Figure 7:
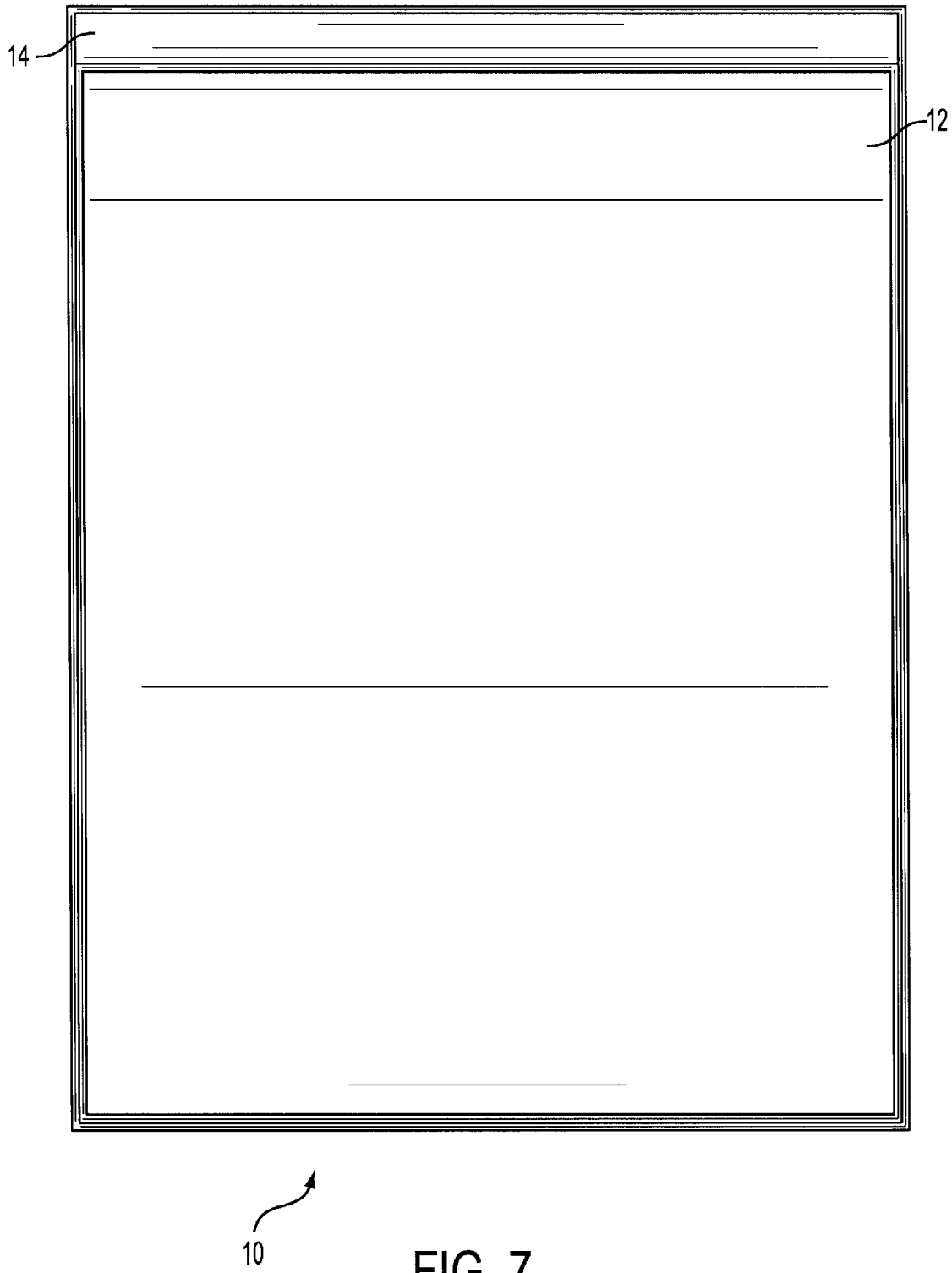
FIG. 7 is a top view of the convertible shoe box and display platform according to the present invention, shown in its display platform configuration.
Figure 8:
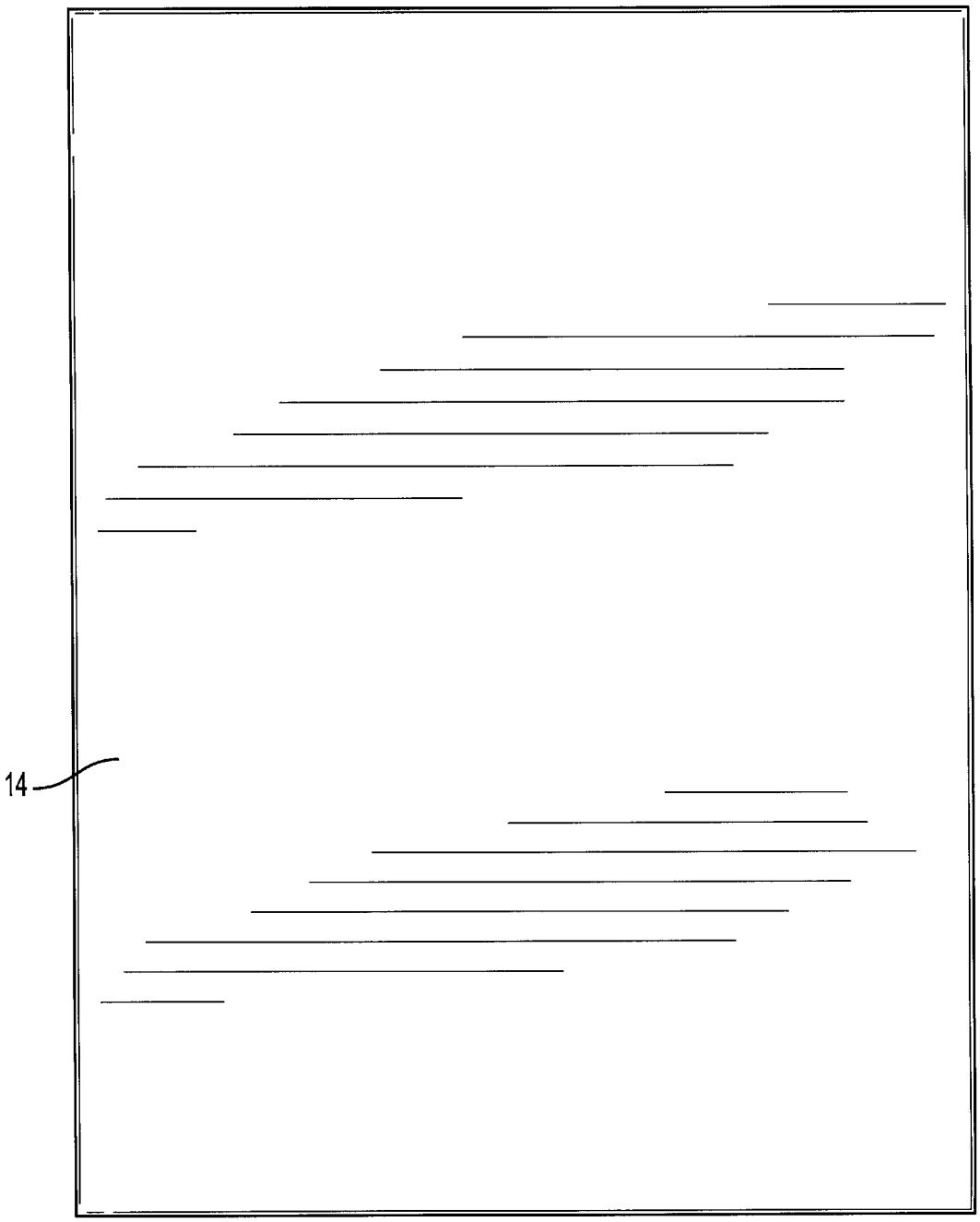
FIG. 8 is a bottom view of the convertible shoe box and display platform shown in FIG. 7.

Referring now to the drawings, wherein like numerals designate like or corresponding parts throughout the several views, there is shown in FIG. 1 a box assembly 10 having assembled and disassembled configurations for storing and displaying a pair of shoes. The box assembly 10 includes a container portion 12, a lid portion 14 that is adapted to cover the container portion 12, and thereby enclose the pair of shoes (not shown) within the assembled box 10, and means 16 for positioning the disassembled box as a display platform. In such a manner, the pair of shoes remaining in the container portion 12, and is effectively displayed for sale.

Figure 12:
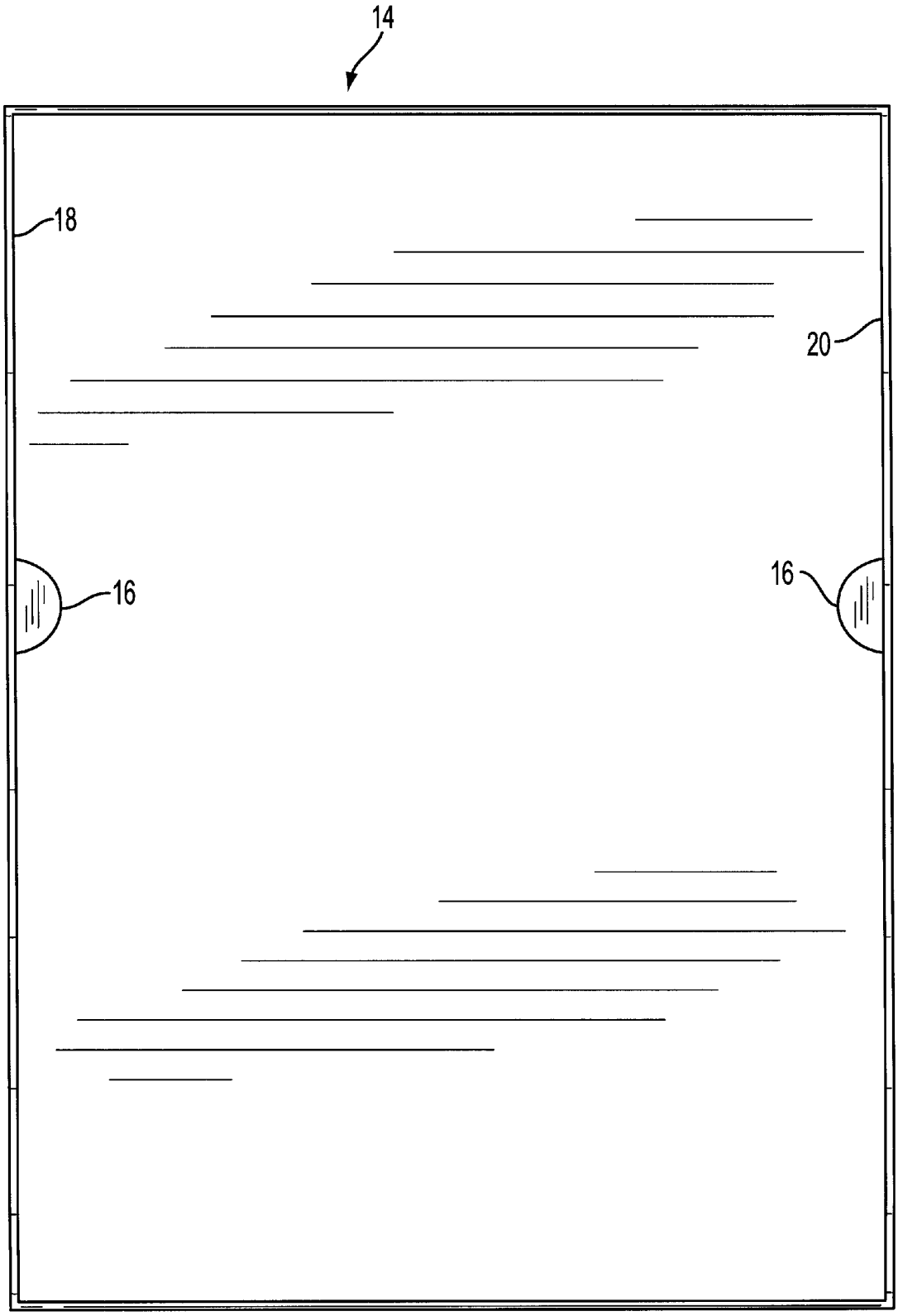
FIG. 12 is an interior, top view of the cover portion of the convertible shoe box and display platform according to the present invention, with opposing tab elements shown extending inwardly.

Positioning means 16 according to one embodiment of the present invention comprises one or more integral parts, such as a pair of tabs, of the lid portion 14. The tabs 16 are disposed such that one tab 16 opposes the other on respective sides 18, 20 (see FIG. 12) of the lid portion 14. Preferably each tab 16 is formed in the shape of a semicircle, square, rectangle, triangle, semi-ellipse, or any other suitable shape adapted for extension inwardly from the respective side 18, 20 of the lid portion 14. Such shapes are easily formed by scoring, cutting, or pressing.

Figure 9:
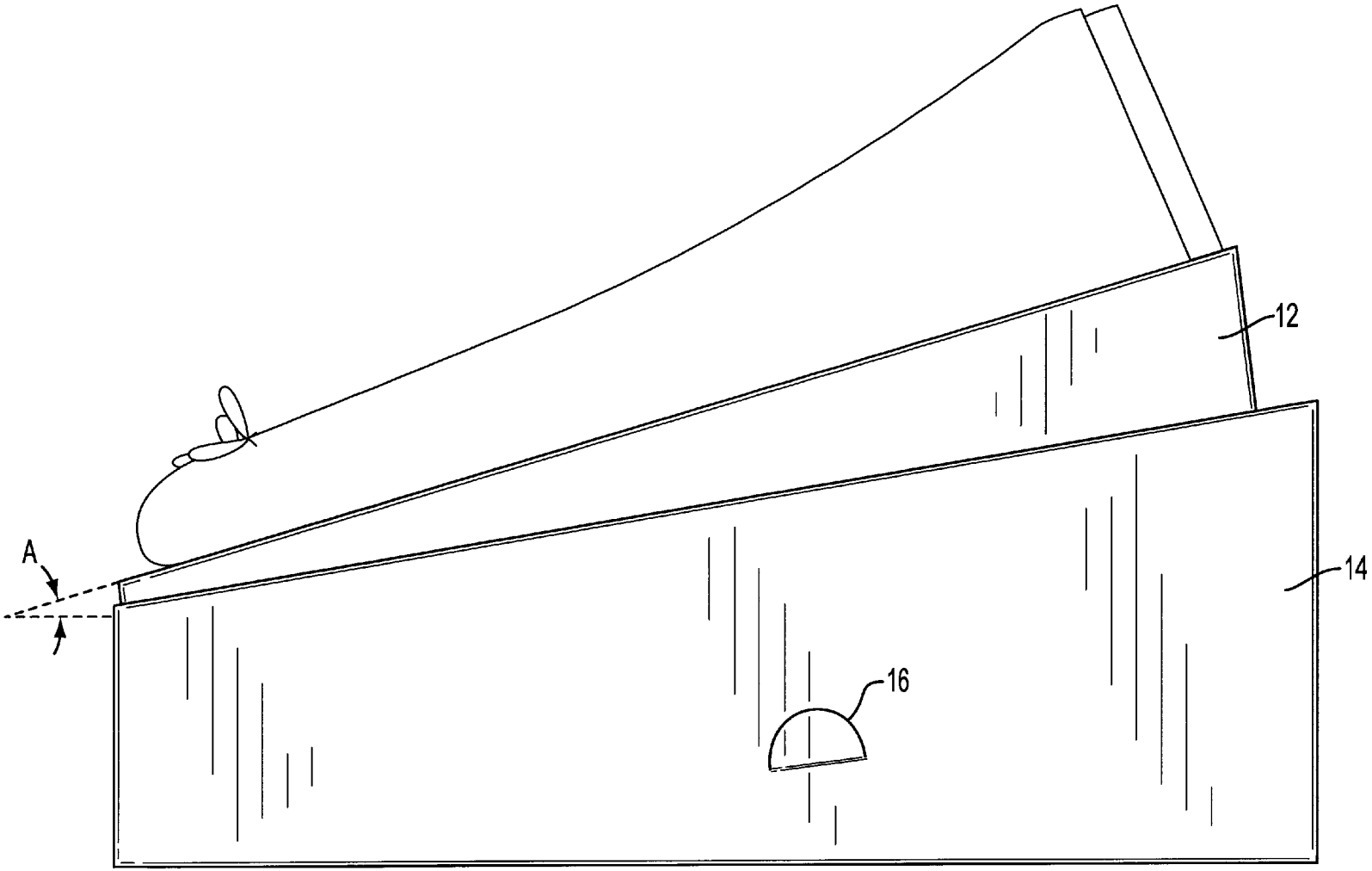
FIG. 9 is a side view of the convertible shoe box and display platform shown in FIG. 7.
Figure 10:
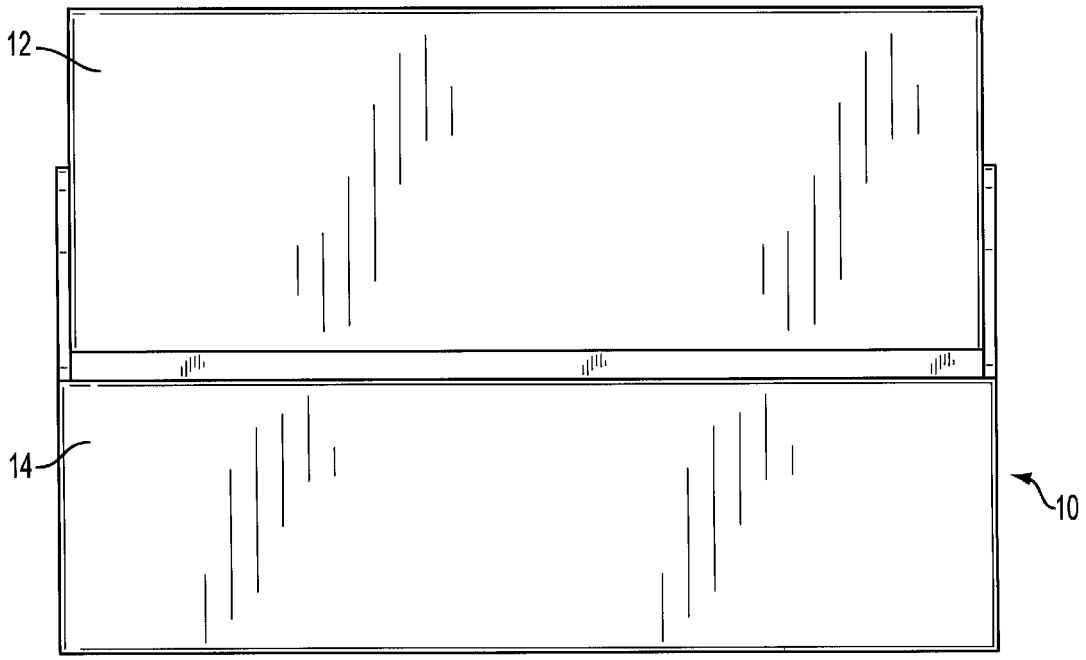
FIG. 10 is a front view of the convertible shoe box and display platform shown in FIG. 7.
Figure 11:
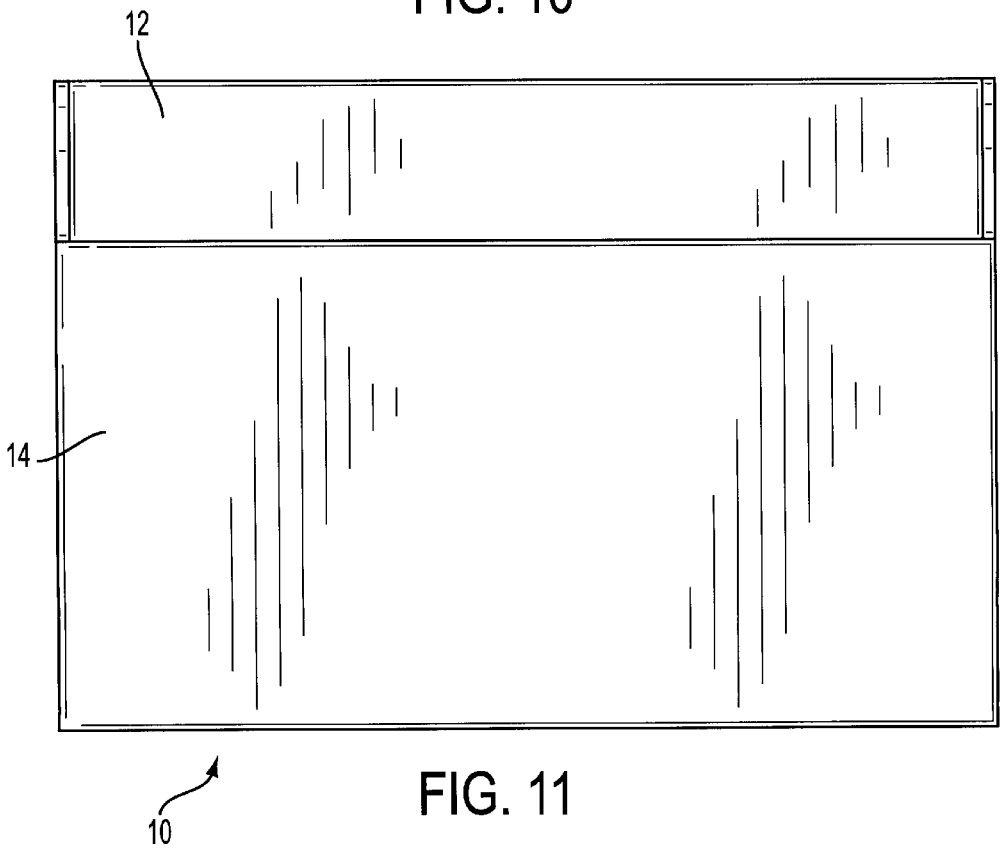
FIG. 11 is a back view of the convertible shoe box and display platform shown in FIG. 7.

It has been found that the container portion 12 and the lid portion 14 should comprise a substantially wedge-shape which is complementary to the other. In such a manner, the positioning means 16 is adapted to elevate the container portion 12 together with the pair of shoes remaining therein at an effective angle for display. Referring for the moment to FIG. 9, it can be seen that the effective angle A suitably comprises a range of about ten degrees to fifteen degrees.

In accordance with yet another important aspect of the present invention, a simple method of storing, shipping, and offering a pair of shoes for sale within a combined shoe box and display platform is provided in the following manner. Three simple steps of first providing the first or container portion 12 adapted to contain the pair of shoes; second providing a second or lid portion 14 adapted to cover the first portion 12, and thereby enclose the pair of shoes for storage and shipment in an assembled configuration (as shown in FIGS. 1–6); and third providing means 16 for positioning the first portion 12 and the second portion 14 in a disassembled configuration (as shown in FIGS. 7–11) by supporting the pair of shoes contained within the first portion 12 at an effective angle A for display.

The third providing step preferably comprises the steps of: forming a pair of tabs 16 as an integral part of the second portion 12 on opposing sides 18, 20 thereof, extending the pair of tabs 16 inwardly from the opposing sides 18, 20; and supporting the pair of shoes contained within the first portion 12 upon the inwardly extending pair of tabs 16.

Figure 13:
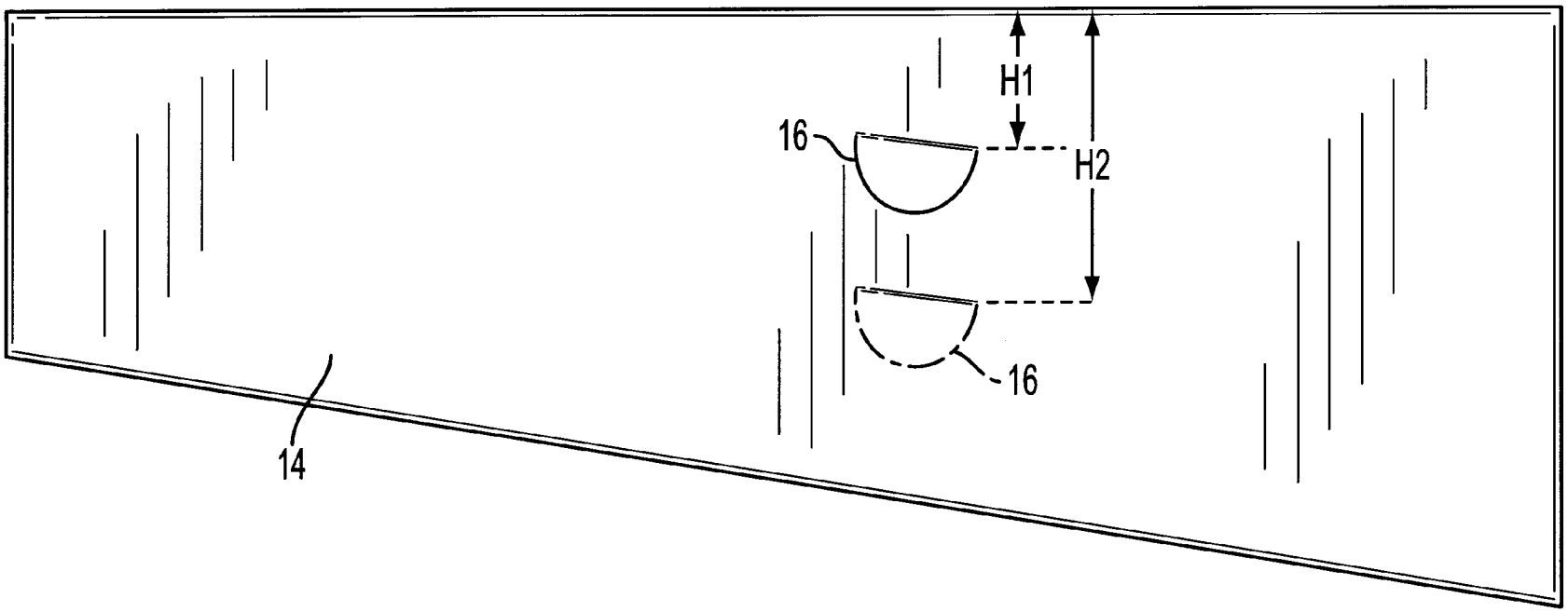
FIG. 13 is a side view of the cover portion shown in FIG. 12.
Figure 14:
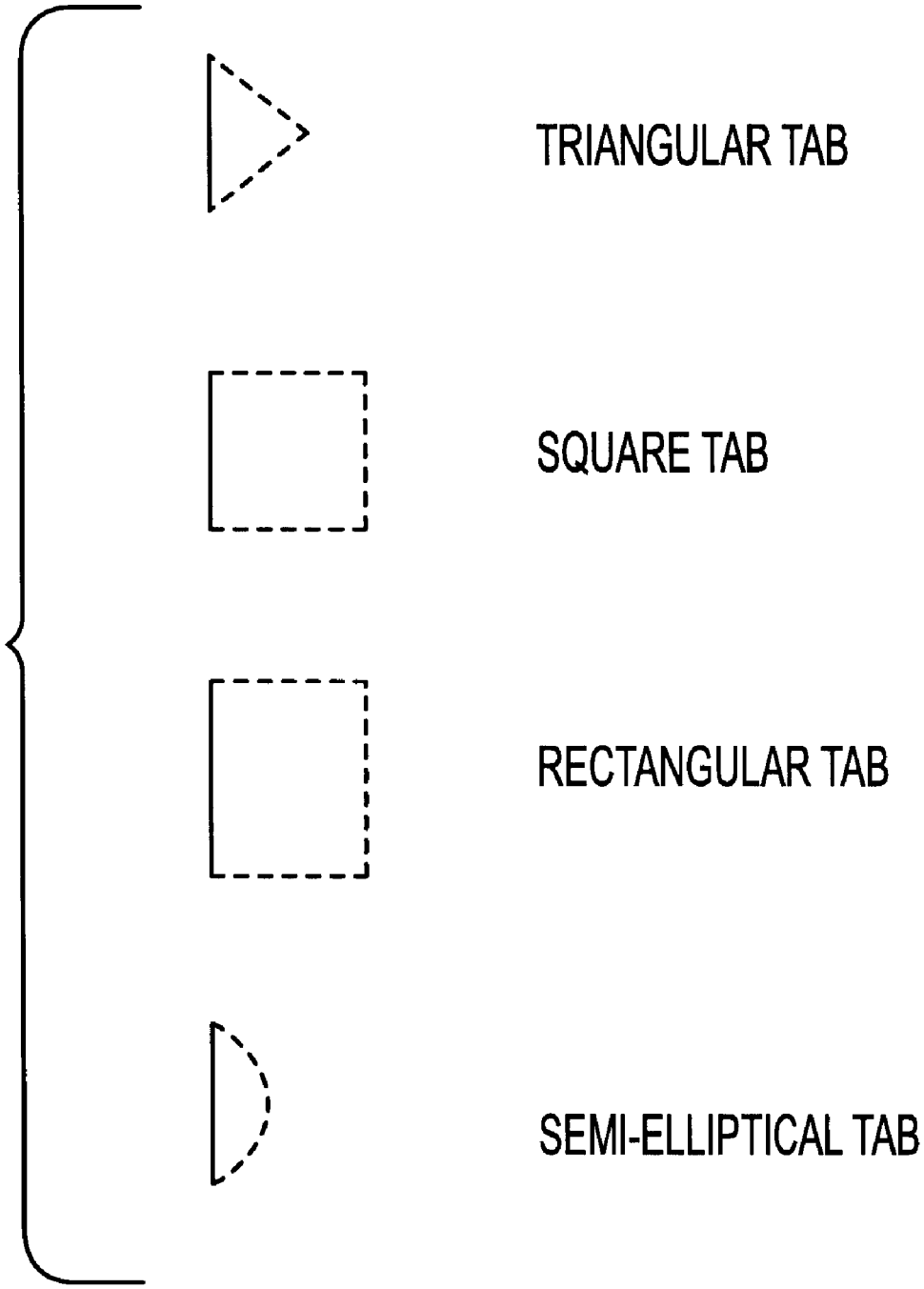
FIG. 14 shows some of the various shapes of the tabs.

In accordance with one embodiment of the present invention, such third providing step comprises the steps of:

forming two or more pairs of tabs 16 (additional tabs shown in phantom in FIGS. 1 and 13) as an integral part of the second portion 14 on opposing sides 18, 20 thereof, each of the pairs of tabs 16 formed at a relatively different height H1, H2 of the opposing sides 18, 20; selecting a pair of the tabs 16, extending the selected pair of tabs 16 inwardly from the opposing sides 18, 20; and supporting the pair of shoes contained within the first portion 12 upon the inwardly extending pair of tabs 16.

The extending step, on the one hand, comprises the steps of: pressing a first tab 16 inwardly from its respective side 18 of the second portion 14 to a position substantially perpendicular therefrom, and pressing a second tab 16 inwardly from an opposite side 20 of the second portion to a position substantially perpendicular therefrom. In this case, the first tab 16 and the second tab 16 are positioned at the same height H1.

Alternatively, the extending step may suitably comprise the steps of: pressing a first tab 16 inwardly from its respective side 18 of the second portion to a position substantially perpendicular therefrom, and pressing a second tab 16 inwardly from an opposite side 20 of the second portion to a position substantially perpendicular therefrom. In this case, the first tab 16 and the second tab 16 are positioned at different heights H1, H2.

Obviously, many modifications and variations of the combined shoe box and display platform according to the present invention are possible when viewed in light of the foregoing teachings. For example, while conventional paperboard manufacturing processes known for the production of shoe boxes can be used in manufacturing the combined shoe box and display platform according to the present invention, other related processes (e.g., corrugated paper and/or coated paper, and plastics manufacturing processes) may be used. It should be understood, therefore, that all such forms of paper and plastics used in box making, as well as modifications and variations thereto, could be used in accordance with the present invention and would, thus, be deemed to fall within the scope of the appended claims.

What we claim as our Invention is:

1. A method for storing, shipping and offering a pair of shoes for sale within a combined shoe box and display platform, said combined shoe box and display platform having a first portion adapted to contain the pair of shoes and having a second portion adapted to cover said first portion, thereby enclosing the pair of shoes for storage and shipment in an assembled configuration, said second portion having a plurality of integral tabs, wherein a matching pair of tabs is disposed such that one tab opposes the other on respective sides of said second portion, comprising the steps of:

positioning the pair of shoes in said first portion;

covering said first portion with said second portion for shipping said pair of shoes; and positioning said first portion and said second portion in a disassembled configuration for supporting the pair of shoes contained within said first portion at an effective angle for display;

wherein said disassembled configuration positioning step further comprises the substeps of:

forming two or more pairs of tabs of said plurality of tabs as an integral part of said second portion on opposing sides thereof, said pairs of tabs being formed at relatively different heights of said opposing sides and one of said pairs of tabs being said matching pairs of tabs;

extending said matching pair of tabs inwardly from said opposing sides; and supporting said first portion upon said inwardly extending matching tabs;

wherein said extending step comprises the substeps of:

pressing a first tab of said matching pair of tabs inwardly from its respective side of said second portion to a position substantially perpendicular therefrom; and pressing a second tab of said matching pair of tabs inwardly from its respective side of said second portion to a position substantially perpendicular therefrom; and wherein said first tab of said matching pair of tabs and said second tab of said matching pair of tabs are positioned at the same height.

2. A method for storing, shipping and offering merchandise for sale within a combined box and display platform, said combined box and display platform having a first portion adapted to contain the merchandise and having a second portion adapted to cover said first portion, thereby enclosing the merchandise for storage and shipment in an assembled configuration, said second portion having two or more pairs of tabs that are formed as an integral part of said second portion on opposing sides thereof, with each of said pairs of tabs being disposed at a relatively different height on said opposing sides, comprising the steps of:

(a) positioning the merchandise in said first portion;

(b) covering said first portion with said second portion for shipping the merchandise; and (c) positioning said first portion and said second portion in a disassembled configuration for supporting the merchandise contained within said first portion at an effective angle for display, step (c) including:

selecting one of said pairs of tabs, extending said selected pair of tabs inwardly from said opposing sides, by pressing a first tab of said selected pair inwardly from its respective side of said second portion to a position substantially perpendicular therefrom and pressing a second tab of said selected pair inwardly from its respective side of said second portion to a position substantially perpendicular therefrom, and supporting said first portion upon said inwardly extending selected tabs, wherein said first tab of said selected pair and said second tab of said selected pair are positioned at the same height.

3. The method according to claim 2, wherein said effective angle for display lies in a range of about ten degrees to fifteen degrees.

4. The method according to claim 2, further comprising the steps of selecting as said first portion and said second portion, a container portion and a lid portion which are generally wedge-shaped and which are complementary to the other.

5. The method according to 2, wherein said first and second tabs of said selected pair each has a substantially semi-circular shape adapted for extension inwardly from its respective side of said second portion.

6. The method according to claim 2, wherein said first and second tabs of said selected pair each has a substantially square shape adapted for extension inwardly from its respective side of said second portion.

7. The method according to claim 2, wherein said first and second tabs of said selected pair each has a substantially rectangular shape adapted for extension inwardly from its respective of said second portion.

8. The method according to claim 2, wherein said first and second tabs of said selected pair each has a substantially triangular shape adapted for extension inwardly from its respective side of said second portion.

9. The method according to claim 2, wherein said first and second tabs of said selected pair each has a substantially semi-elliptical shape adapted for extension inwardly form its respective side of said second portion.

* * * * *